US010222760B2

(12) United States Patent
Hasegawa

(10) Patent No.: US 10,222,760 B2
(45) Date of Patent: Mar. 5, 2019

(54) ELECTRONIC TIMEPIECE

(71) Applicant: CASIO COMPUTER CO., LTD., Shibuya-ku, Tokyo (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 35 days.

(21) Appl. No.: 15/204,700

(22) Filed: Jul. 7, 2016

(65) Prior Publication Data

US 2017/0082981 A1 Mar. 23, 2017

(30) Foreign Application Priority Data

Sep. 17, 2015 (JP) ..... 2015-183610

(51) Int. Cl.

| | |
|---|---|
| ***G04G 9/00*** | (2006.01) |
| ***G04B 19/04*** | (2006.01) |
| ***G04B 47/00*** | (2006.01) |
| ***G04C 3/14*** | (2006.01) |
| ***G04B 19/08*** | (2006.01) |

(52) U.S. Cl.

CPC ..... *G04G 9/0005* (2013.01); *G04B 19/04* (2013.01); *G04B 19/082* (2013.01); *G04B 47/005* (2013.01); *G04C 3/14* (2013.01); *G04C 3/146* (2013.01)

(58) Field of Classification Search

CPC .... G04B 19/04; G04B 19/082; G04B 47/005; G04C 3/14; G04C 3/146; G04G 9/0005; H02P 8/20

See application file for complete search history.

(56) References Cited

U.S. PATENT DOCUMENTS

| | | | | |
|---|---|---|---|---|
| 4,095,553 | A * | 6/1978 | Ono | G01P 1/11 116/62.3 |
| 4,357,693 | A * | 11/1982 | Plancon | G04C 3/14 368/187 |
| 4,511,832 | A * | 4/1985 | Schmitz | H02H 7/0851 318/685 |
| 5,119,349 | A * | 6/1992 | Muto | G04C 3/14 368/107 |
| 5,877,694 | A * | 3/1999 | Kataoka | G01R 7/06 318/685 |
| 6,490,230 | B1 * | 12/2002 | Sakuyama | G04C 3/14 368/11 |
| 6,542,439 | B1 * | 4/2003 | Satodate | G04B 19/048 368/223 |

(Continued)

FOREIGN PATENT DOCUMENTS

| | | | | |
|---|---|---|---|---|
| CH | 709222 | A2 * | 8/2015 | G04B 19/02 |
| JP | 2012068245 | A | 4/2012 | |
| WO | WO 9521429 | A1 * | 8/1995 | A44B 15/005 |

*Primary Examiner* — Daniel P Wicklund

(74) *Attorney, Agent, or Firm* — Holtz, Holtz & Volek PC

(57) ABSTRACT

An electronic timepiece, including: a reciprocating hand which is provided to be rotatable only within a partial angle range of a circle; and a processor which acquires information according to an operation of the reciprocating hand, and makes the reciprocating hand perform a predetermined notification operation when a destination of the reciprocating hand is out of the angle range, the destination being determined on the basis of the information.

15 Claims, 6 Drawing Sheets

(56) References Cited

U.S. PATENT DOCUMENTS

| | | | | |
|---|---|---|---|---|
| 6,618,326 | B1 * | 9/2003 | Satodate | G04B 19/04 368/223 |
| 8,237,394 | B2 * | 8/2012 | Nakane | G01R 7/06 116/62.1 |
| 8,717,853 | B2 | 5/2014 | Courvoisier et al. | |
| 2001/0012242 | A1 * | 8/2001 | Yamaya | G04C 3/14 368/187 |
| 2004/0108829 | A1 * | 6/2004 | Betts | H02P 8/22 318/696 |
| 2005/0002277 | A1 * | 1/2005 | Fukuda | G01D 5/2412 368/80 |
| 2006/0144172 | A1 * | 7/2006 | Sasaki | G01P 1/07 73/866.1 |
| 2006/0255761 | A1 * | 11/2006 | Fekete | H02P 8/02 318/696 |
| 2008/0084792 | A1 * | 4/2008 | Hayashi | G04C 3/008 368/80 |
| 2008/0151700 | A1 * | 6/2008 | Inoue | B60K 37/02 368/80 |
| 2008/0253235 | A1 * | 10/2008 | Hiraga | G04B 19/082 368/172 |
| 2009/0185457 | A1 * | 7/2009 | Sigelmann | G04B 45/043 368/220 |
| 2010/0192836 | A1 * | 8/2010 | Nakane | B60K 37/02 116/297 |
| 2012/0240659 | A1 * | 9/2012 | Alfano | G01L 7/043 73/1.57 |
| 2014/0064040 | A1 * | 3/2014 | Hirokawa | G04B 19/02 368/80 |
| 2014/0092714 | A1 * | 4/2014 | Nagareda | G04C 3/14 368/187 |
| 2015/0268635 | A1 * | 9/2015 | Kobayashi | G04C 3/001 368/107 |

* cited by examiner

ELECTRONIC TIMEPIECE

BACKGROUND OF THE INVENTION

1. Field of the Invention

The present invention relates to an electronic timepiece which performs display by using hands.

2. Description of Related Art

There have been conventionally hand-type display devices which perform display according to dates and times and other various functions by using hands.

In such display devices, hands for displaying times in timepieces and such like rotate and indicate elapse of respective predetermined times such as 1 minute, 1 hour and 12 hours by a single rotation in many cases.

On the other hand, hands for displaying measurement values by sensors and such like are configured to perform reciprocating motions within limited angle ranges in many cases. There is also a display technique called retrograde mechanism in which the operation is allowed only within a predetermined angle range even for a hand displaying a time, and when a hand reaches an end of the range, the hand is immediately moved backward and returned to the other end.

There are also timepieces for various effects by exposing only partial angle ranges of rotating hands. Japanese Patent Application Laid Open Publication No. 2012-68245 which is a Japanese patent document discloses a technique which exposes a partial operation range for each of a plurality of hands and displays the entire angle range by the total of exposed partial ranges. The technique generates a visual effect by making the hands perform a same operation and perform display in different exposed parts according to the ranges indicated by the hands.

On the other hand, in electronic timepieces which move hands electrically by using stepping motors, it has been conventionally possible to arbitrarily control the operation of hands in both rotation directions. However, in a case where the display range allowing a hand to operate is a limited angle range, there is a problem that when an operation instruction is input to move the hand out of the display range, the hand simply goes out of the range and the user does not recognize such input when the input is continued further.

SUMMARY OF THE INVENTION

An object of the present invention is to provide an electronic timepiece which can let a user know that a hand is out of a movement range.

In order to solve the above object, according to one aspect of the present invention, there is provided an electronic timepiece, including: a reciprocating hand which is provided to be rotatable only within a partial angle range of a circle; and a processor which acquires information according to an operation of the reciprocating hand, and makes the reciprocating hand perform a predetermined notification operation when a destination of the reciprocating hand is out of the angle range, the destination being determined on the basis f the information.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Hereinafter, an embodiment of the present invention will be described with reference to the drawings.

Figure 1:
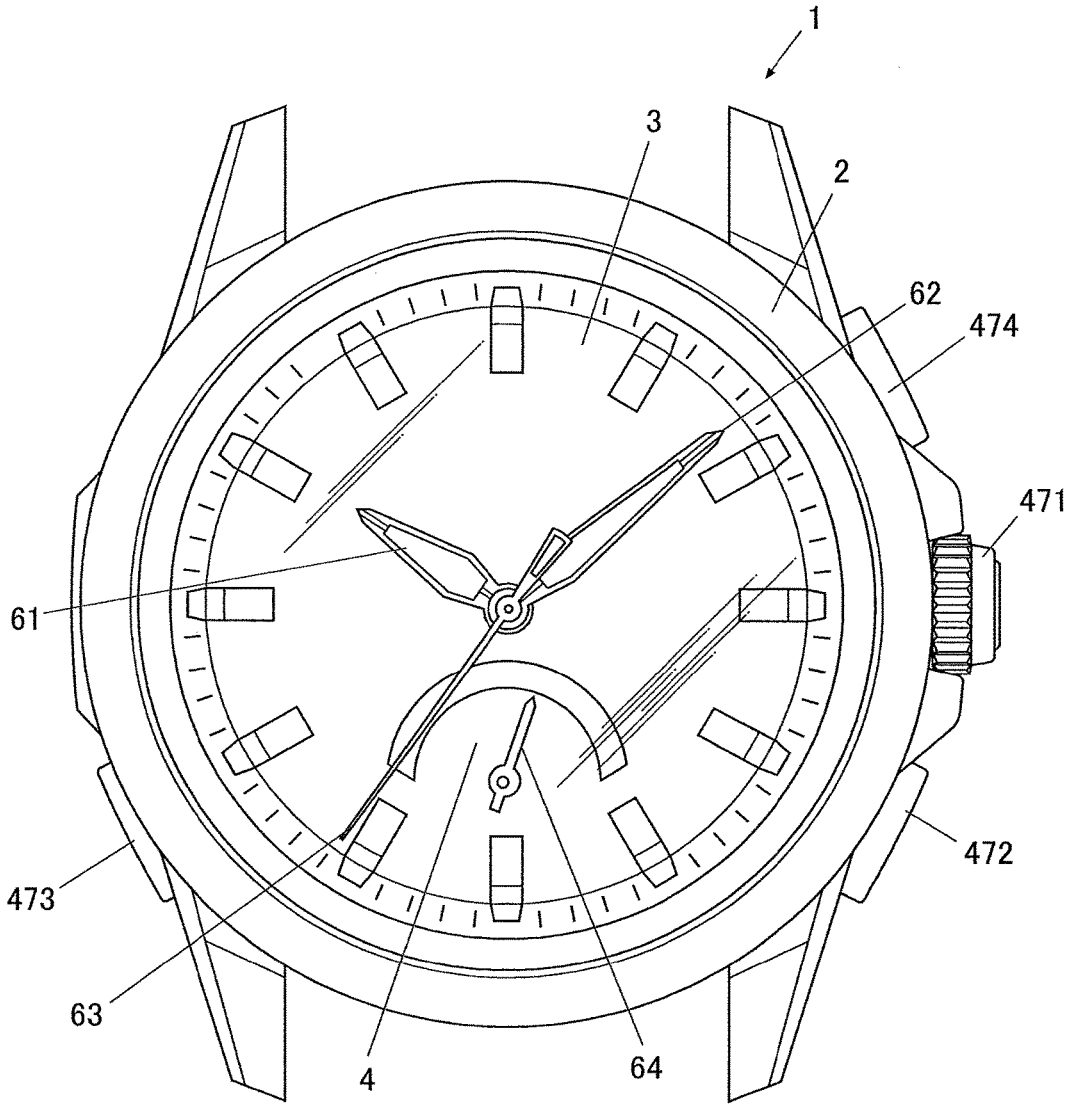
FIG. 1 is a front view showing an electronic timepiece in an embodiment of the present invention.

FIG. 1 is a front view of an analog electronic timepiece 1 which is an embodiment of an electronic timepiece of the present invention.

The analog electronic timepiece 1 includes: a casing 2 which contains components therein; a dial plate 3 which has one surface (exposed surface) exposed outside in the casing 2; a transparent member (windshield glass) not shown in the drawings which covers the exposed surface of the dial plate 3; three time hands 61 to 63 which rotate over the nearly entire surface of the dial plate 3 around the nearly center of dial plate 3 as the rotation axis between the dial plate 3 and the transparent member, and point to scales and marks provided around the outer edge of the exposed surface of dial plate 3; a small window 4 which is provided at a six o'clock position of dial plate 3; a function hand 64 (reciprocating hand) which rotates inside the small window 4; a crown 471 which is provided on a lateral surface of the casing 2; push button switches 472 to 474 and such like.

The time hands 61 to 63 are an hour hand 61, a minute hand 62 and a second hand 63, and normally indicate hour, minute and second of time respectively when displaying the time. In the analog electronic timepiece 1 in the embodiment, the second hand 63 is used for display and setting according to various functions.

The function hand 64 has a rotation axis near the lower end of small window 4 which is in a nearly semicircle shape. The function hand 64 can rotate only in a range (movement angle range) of 12 o'clock side (upper side) which is a partial angle range of the 360 degrees circle inside the small window 4. Though the value which can be displayed is not limited, for example, an altitude value which was acquired based on the measurement value by a sensor 48 can be displayed within a set range. Hereinafter, a part or all of the time hands 61 to 63 and the function hand 64 are also collectively referred to as hands 61 to 64, for example.

The crown 471 receives an input operation from a user. The crown 471 can be pulled out from the casing 2 in two steps, for example, and can change setting values according to various settings by rotating while being pulled out by one step or two steps.

The push button switches 472 to 474 receive a push operation by the user.

Figure 2:
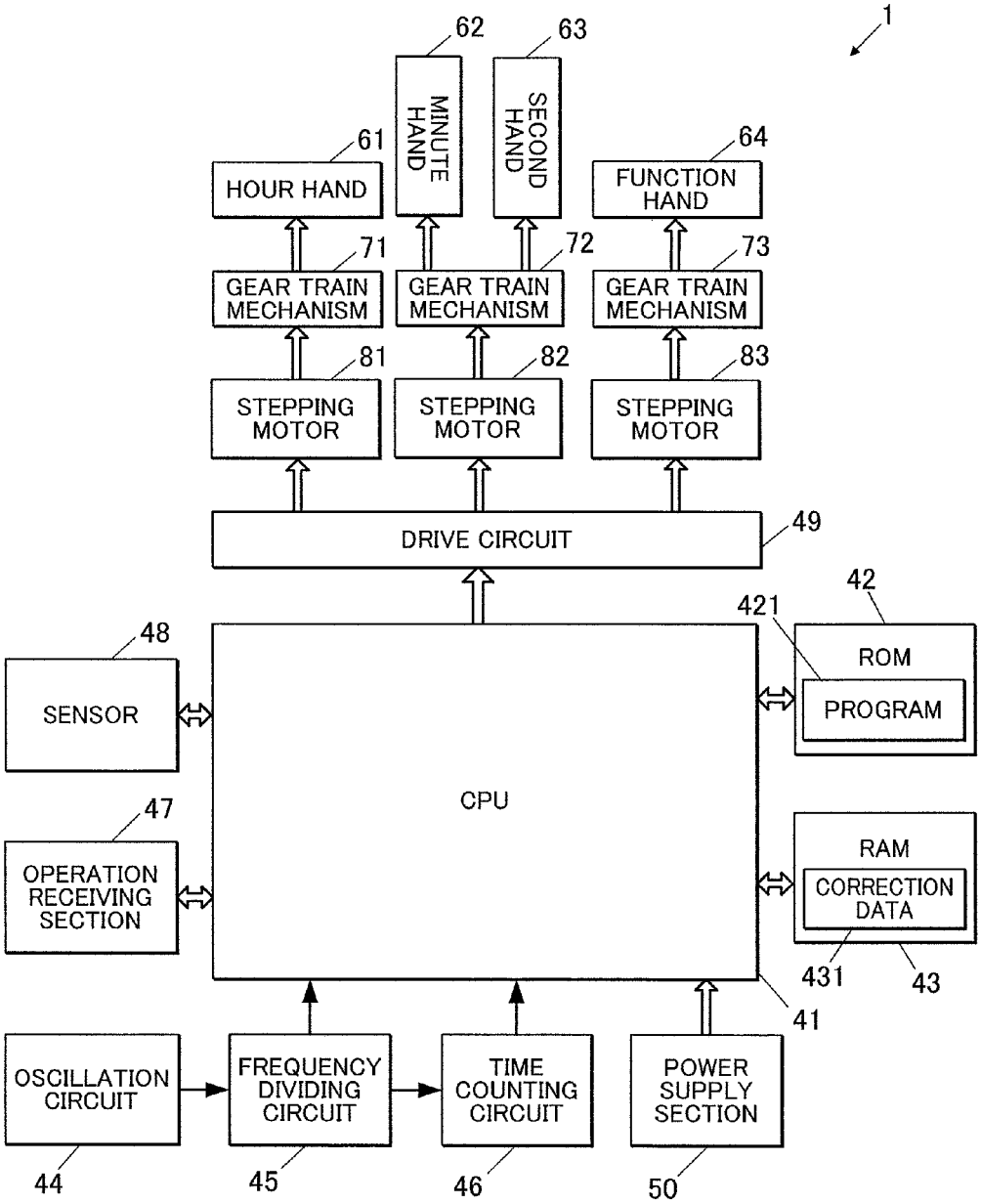
FIG. 2 is a block diagram showing a functional configuration of the electronic timepiece.

FIG. 2 is a block diagram showing an internal configuration of the analog electronic timepiece 1.

The analog electronic timepiece 1 includes a CPU 41 (Central Processing Unit) as a processor, a ROM 42 (Read Only Memory), a RAM 43 (Random Access Memory), an oscillation circuit 44, a frequency dividing circuit 45, a time counting circuit 46, an operation receiving section 47, a sensor 48, a drive circuit 49, a power supply section 50, the above time hands 61 to 63 and function hand 64, gear train mechanisms 71 to 73, stepping motors 81 to 83 and such like.

The CPU 41 performs various types of arithmetic processing and integrally controls the entire operation of the analog electronic timepiece 1. The CPU 41 controls hand operations according to display of dates and times and display of measurement values by the sensor 48.

Various control programs 421 executed by the CPU 41 and setting data are stored in the ROM 42. The programs 421 include programs according to operation controls of the hands 61 to 64 in various types of function modes.

The RAM 43 provides a working memory space to the CPU 41, and temporary data is stored in the RAM 43. In the RAM 43, data indicating hand positions and correction data 431 of a table used for converting an air pressure value into an altitude value when displaying the altitude value are stored.

The oscillation circuit 44 generates and outputs a predetermined frequency signal. The oscillation circuit 44 includes a crystal oscillator, for example.

The frequency dividing circuit 45 divides a frequency signal output from the oscillation circuit 44 into frequency signals used by the CPU 41 and the time counting circuit 46, and outputs the divided signals. The output frequency may be set to be changeable by a control signal from the CPU 41.

The time counting circuit 46 counts the current date and time by counting the divided frequency signals input from the frequency dividing circuit 45 and adding the counted value to an initial value indicating predetermined date and time. The date and time counted by the time counting circuit 46 can be corrected by a control signal from the CPU 41.

The operation receiving section 47 receives an input operation from a user. The operation receiving section 47 includes the crown 471 and push button switches 472 to 474 When the crown 471 is pulled out, pushed back or rotated, or one of the push button switches 472 to 474 is pushed down, an electrical signal according to the type of the operation is output to the CPU 41.

The sensor 48 measures predetermined spatial physical quantity. Though not especially limited, the sensor 48 can measure temperature, humidity, and air pressure, for example. Conversion of temperature between Celsius and Fahrenheit, conversion of an air pressure value into an altitude value and such like are executed separately by the CPU 41, for example.

The power supply section 50 supplies electric power according to operations of sections at a predetermined voltage from a battery. A combination of solar panel and a secondary battery is used as the battery, for example. A button type dry cell which is detachable to be replaced may also be used as the battery. In a case where the power supply section 50 outputs a plurality of different voltages, a switching power supply or the like can be used for conversion into a desired voltage to allow the output of different voltages.

The drive circuit 49 outputs a drive pulse at a predetermined voltage to the stepping motors 81 to 83 in accordance with a control signal from the CPU 41. The drive circuit 49 can change the length (pulse width) and amplitude (peak voltage value) of drive pulse according to the state of analog electronic timepiece 1. When a control signal of simultaneously driving a plurality of hands is input, the drive circuit 49 can slightly shift the output timing of drive pulse in order to reduce the load.

The stepping motor 81 rotates the hour hand 61 via the gear train mechanism 71 which has a plurality of arranged gears. When the stepping motor 81 is driven once, the hour hand 61 is rotated 1 degree as one step. When the stepping motor 81 is driven 360 times, the hour hand 61 makes one rotation on the dial plate 3.

The stepping motor 82 rotates the minute hand 62 and the second hand 63 via the gear train mechanism 72. The gear train mechanism 72 makes the minute hand 62 and the second hand 63 rotate in conjunction with each other. The gear train mechanism 72 makes the second hand 63 by 6 degrees and makes the minute hand 62 rotate by 1/10degree. Accordingly, by moving once per second, the second hand 63 makes one rotation on the dial plate 3 in one minute. Meanwhile, the minute hand 62 moves 6 degrees on the dial plate 3. That is, the minute hand 62 Lakes one rotation on the dial plate 3 in one hour.

The stepping motor 83 rotates the function hand 64 via the gear train mechanism 73. When the stepping motor 83 is driven once, the function hand 64 moves a predetermined angle (for example, 1 degree). As described above, the function hand 64 can be rotated only within the range of 180 degrees which is a semicircle on 12 o'clock side, and the function hand 64 can move for 180 steps in the 180 degree range. Normally, the CPU 41 does not allow the hand to move out of the both ends of the range on the basis location information of function hand 64 stored in the RAM 43. The function hand 64 and/or the gear train mechanism 73 may be provided with a stopper or the like for avoiding the movement of the function hand 64 out of the display range, to make the rotor of stepping motor 83 run idle.

Though not especially limited, the time hands 61 to 63 and the function hand 64 can be rotated both in the forward direction (clockwise direction) and in the backward direction at a maximum of 128 pps (pulse per second)

Next, the operation of function hand 64 in the analog electronic timepiece 1 of the embodiment will be described.

In the analog electronic timepiece 1 of the embodiment, when a movement request requesting the function hand 64 for movement to a destination out of the display range is acquired, the function hand 64 by itself performs a notification operation indicating that the operation of function hand 64 according to the movement request is difficult. The analog electronic timepiece 1 performs the notification by, for example, making the function hand 64 perform a pattern operation (swing back operation) once or a plurality of times, the pattern operation being an operation of making the function hand 64 reciprocate by fast forwarding the function hand 64 by a predetermined number of steps from the end position of the display range to inside the display range and returning the function hand 64 to the end position by fast forwarding, the end position being a position where the function hand 64 goes out of the display range. In the analog electronic timepiece 1, the degree of notification operation (notification amount) is changed according to the degree of departure from the display range. After the swing back operation, the function hand 64 is stopped at the end position where the function hand 64 is located at the time of ending the swing back operation.

Hereinafter, a display operation will be described for a case of making the function hand 64 display altitude on the basis of the measurement value of air pressure by an air pressure sensor of the sensor 48.

Figure 3:
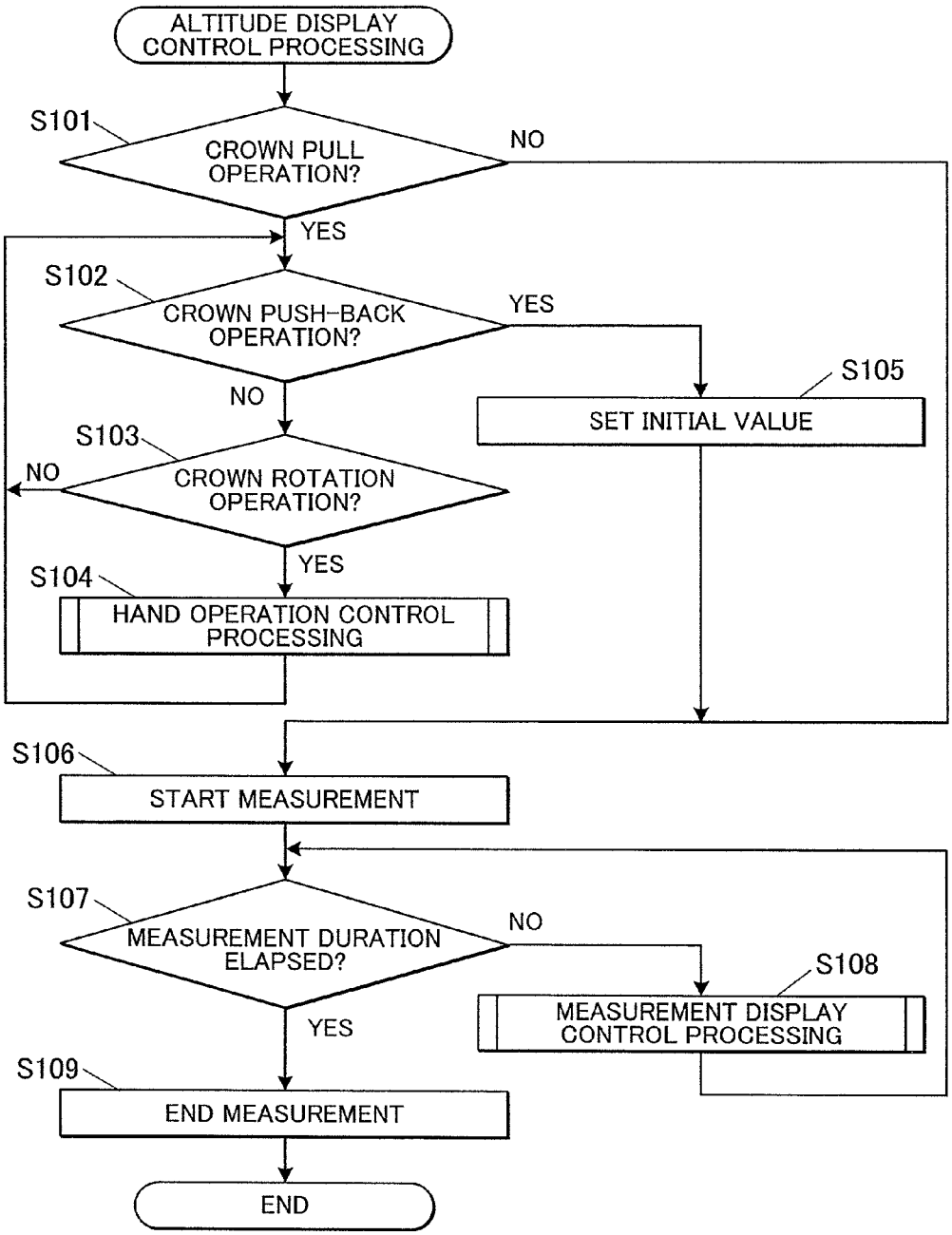
FIG. 3 is a flowchart showing a control procedure of altitude display control processing executed by an analog electronic timepiece in the embodiment.

FIG. 3 is a flowchart showing a control procedure by the CPU 41 of altitude display control processing executed by the analog electronic timepiece 1 in the embodiment.

The altitude display control processing is manually activated on the basis of an input operation to a predetermined one of the push button switches 472 to 474.

When the altitude display control processing is started, the CPU 41 determines whether the pull-out operation of crown 471 is detected (step S101). If it is not determined that the pull-out operation is detected (step S101: NO), the processing of CPU 41 proceeds to step S106.

If it is determined that the pull-out operation is detected (step S101: YES), the CPU 41 determines whether the push-back operation of crown 471 is detected (step S102). If it is not determined that the push-back operation of crown 471 is detected (step S102: NO), the CPU 41 determines whether the rotation operation of crown 471 is detected (step S103). If it is not determined that the rotation operation of crown 472 is detected (step S103: NO), the processing of CPU 41 returns to step S102. If it is determined that the rotation operation of crown 471 is detected (step S103: YES), the CPU 41 invokes and executes after-mentioned hand operation control processing (step S104). When the hand operation control processing is ended, the processing of CPU 41 returns to step S102.

In the determination processing of step S102, if it is determined that the push-back operation of crown 471 is detected (step S102: YES), the CPU 41 sets an initial value of altitude according to the hand position which was set according to the rotation of crown 471 (step S105). Then, the processing of CPU 41 proceeds to step S106.

When the processing proceeds from step S101 or step S105 to step S106, the CPU 41 starts measurement of air pressure by the air pressure sensor of sensor 48 (step S106). At this time, the CPU 41 starts counting measurement time. The CPU 41 determines whether predetermined measurement duration has elapsed (step S107). If it is not determined that the predetermined measurement duration has elapsed, the CPU 41 invokes and executes after-mentioned measurement display control processing (step S108). When the measurement display control processing is ended, the processing of CPU 41 returns to step S107.

If it is determined that the measurement duration has elapsed (step S107: YES), the CPU 41 ends measurement by the air pressure sensor of sensor 48 (step S109), and ends the altitude display control processing.

Figure 4:
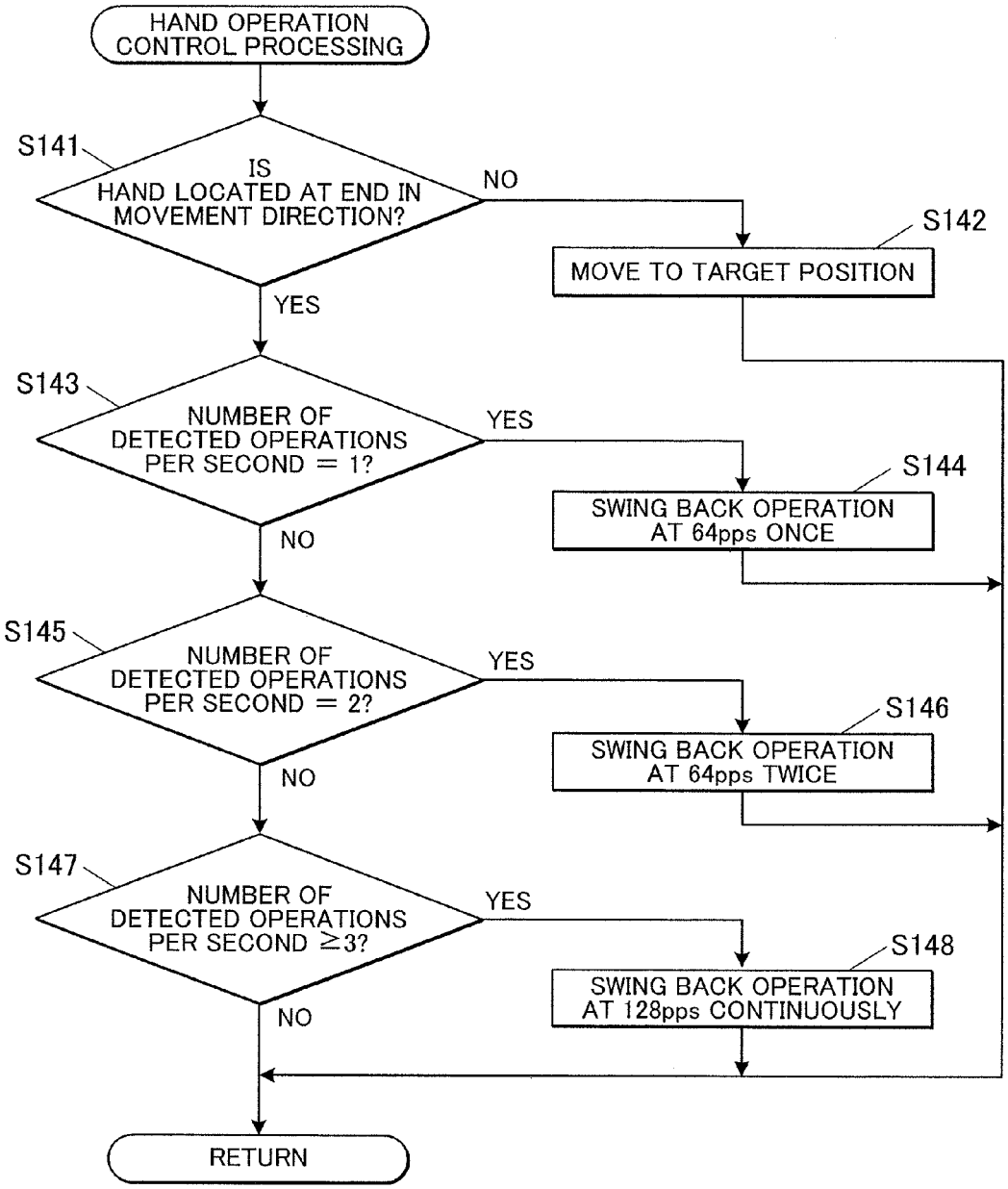
FIG. 4 is a flowchart showing a control procedure of hand operation control processing invoked in the altitude display control processing.

FIG. 4 is a flowchart showing a control procedure by the CPU 41 of hand operation control processing which is invoked in the processing of step S104.

When the hand operation control processing is invoked, the CPU 41 determines whether the function hand 64 is currently located at the end position in the movement direction according to the rotation operation of crown 471 (step S141). If it is not determined that the function hand 64 is located at the end position in the movement direction (step S141:NO), the CPU 41 outputs a control signal of moving the function hand 64 according to the rotation operation of crown 471 to the drive circuit 49 (step S142), and ends the hand operation control processing.

If it is determined that the function hand 64 is located at the end position in the movement direction (step S141: YES), the CPU 41 determines whether the crown operation according to the movement request (excess instruction request) was detected once in the last 1 second, the movement request requesting the function hand 64 for moving out of the movement angle range (step S143). If it is determined that the excess instruction request is detected once (step S143: YES), the CPU 41 outputs, to the drive circuit 49, a control signal for performing the swing back operation at 64 pps (fast forward speed) of fast forwarding the function hand 64 for a predetermined number of steps in the opposite direction to the direction according to the crown operation and thereafter returning the function hand 64 to the previous position by fast forwarding (step S144) Then, the CPU 41 ends the hand operation control processing.

If it is not determined that the excess instruction request was detected once in the last 1 second (step S143: NO), the CPU 41 determines whether the excess instruction request was detected twice in the last 1 second (step S145). If it is determined that the excess instruction request was detected twice (step S145: YES), the CPU 41 outputs, to the drive circuit 49, a control signal for performing the above swing back operation twice (the number of times that a same pattern operation is repeated) at 64 pps (step S146), and ends the hand operation control processing.

If it is not determined that the excess instruction request was detected twice in the last 1 second (step S145: NO), the CPU 41 determines whether the excess instruction request was detected three times or more in the last 1 second (step S147). If it is determined that the excess instruction request was detected three times or more (step S147: YES), the CPU 41 outputs a control signal for repeating the above swing back operation at 128 pps to the drive circuit 49 (step S148), and ends the hand operation control processing while continuing the swing back operation.

If it is not determined that the excess instruction request was detected three times or more (step S147: NO), the CPU 41 determines the result as a counting error and ends the hand operation control processing.

In such way, in the hand operation control processing, when a request for moving the function hand 64 out of the angle range allowing the function hand 64 to move is input by user's operation, the function hand 64 performs a hand operation notifying that the user's operation is not appropriate with the notification degree according to the frequency of acquiring the request and the number of successive requests.

Figure 5:
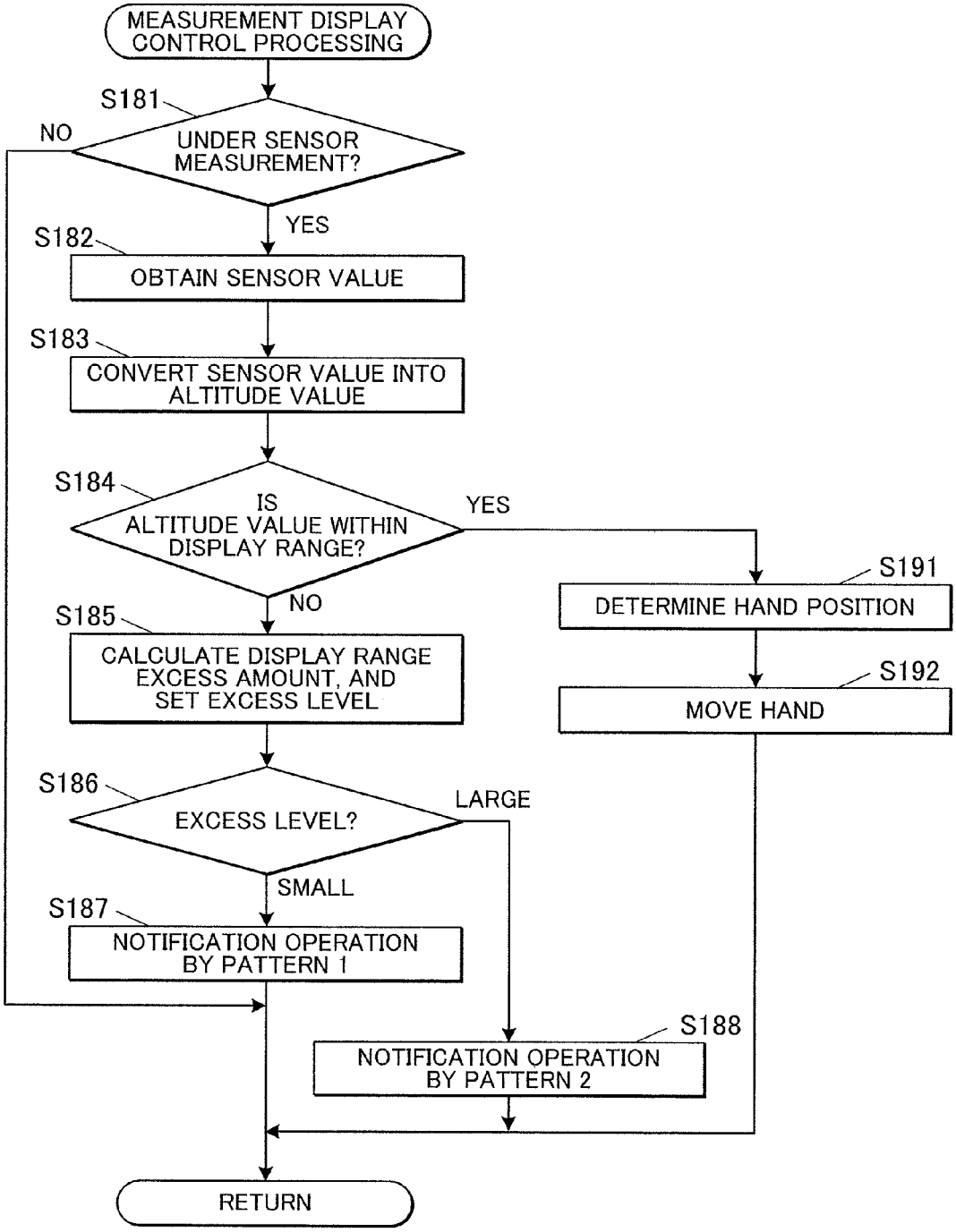
FIG. 5 is a flowchart showing a control procedure of measurement display control processing invoked in the altitude display control processing.

FIG. 5 is a flowchart showing a control procedure by the CPU 41 of measurement display control processing which is invoked in step S108 of the altitude display control processing.

When the measurement display control processing is started, the CPU 41 determines whether measurement is currently performed by the altitude sensor of sensor 48 (step S181). If it is not determined that measurement is currently performed (step S181: NO), the CPU 41 ends the measurement display control processing and returns the processing to the altitude display control processing.

If it is determined that measurement is currently performed (step S181 YES), the CPU 41 acquires a sensor measurement value (information according to measurement result) from the altitude sensor (step S182). The CPU 41 refers to a predetermined conversion table and correction data 431, and converts the measured value into an altitude value (display value) (step S183) At this time, if the measurement value is acquired first from when the initial setting value was set in the processing of step S105 and the correction data 431 is not updated, the set initial value is set to be the altitude value without change, and the correction data 431 is updated according to the altitude value and the acquired sensor measurement value.

The CPU 41 determines whether the acquired altitude value (display value) is within the display range (value range) by the function hand 64 (step S184). If it is not determined that the acquired value is within the display range (step S184 NO), the CPU 41 calculates an excess amount (departure amount) from the display range, and sets the excess level to be large or small (step S185).

The CPU 41 determines whether the set excess level is large or small (step S186). If it is determined that the excess level is small (step S386: small), the CPU 41 outputs a control signal of making the function hand 64 perform a preset notification operation of pattern 1 to the drive circuit 49 (step S187). As the notification operation of pattern 1, for example, the above-mentioned swing back operation is performed at 64 pps for a predetermined number of steps. The CPU 41 ends the measurement display control processing.

If it is determined that the excess level is large (step S186: large), the CPU 41 outputs a control signal of making the function hand 64 perform a preset notification operation of pattern 2 to the drive circuit 49 (step S188). The notification operation of pattern 2 is an operation more noticeable than the notification operation of pattern 1, and increases the amplitude (movement width) or speed (fast forward speed) of swing back operation. For example, the movement operation can be performed at 128 pps which is a double of 64 pps of the swing back operation executed in the above step S187. Then, the CPU 41 ends the measurement display control processing.

If it is determined that the altitude value is within the display range of function hand 64 in the determination processing of step S184 (step S184: YES), the CPU 41 determines the position to be indicated by the function hand 64 according to the acquired altitude value (step S191), and outputs a control signal of fast forwarding the function hand 64 to the determined position to the drive circuit 49 (step S192). Then, the CPU 41 ends the measurement display control processing.

Figure 6A:
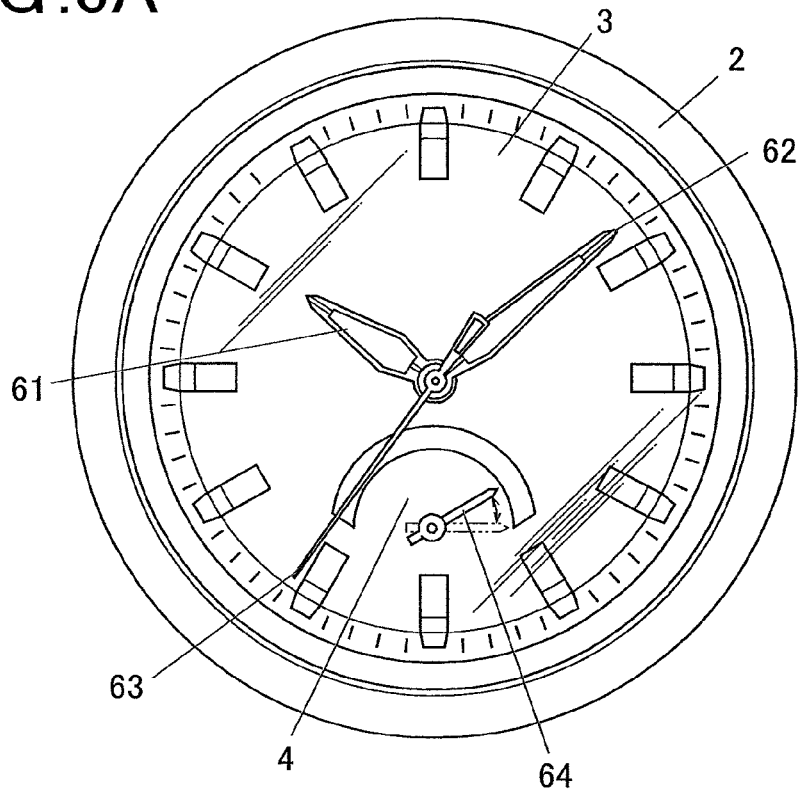
FIG. 6A is a view showing an example of notification operation performed in the measurement display control processing.
Figure 6B:
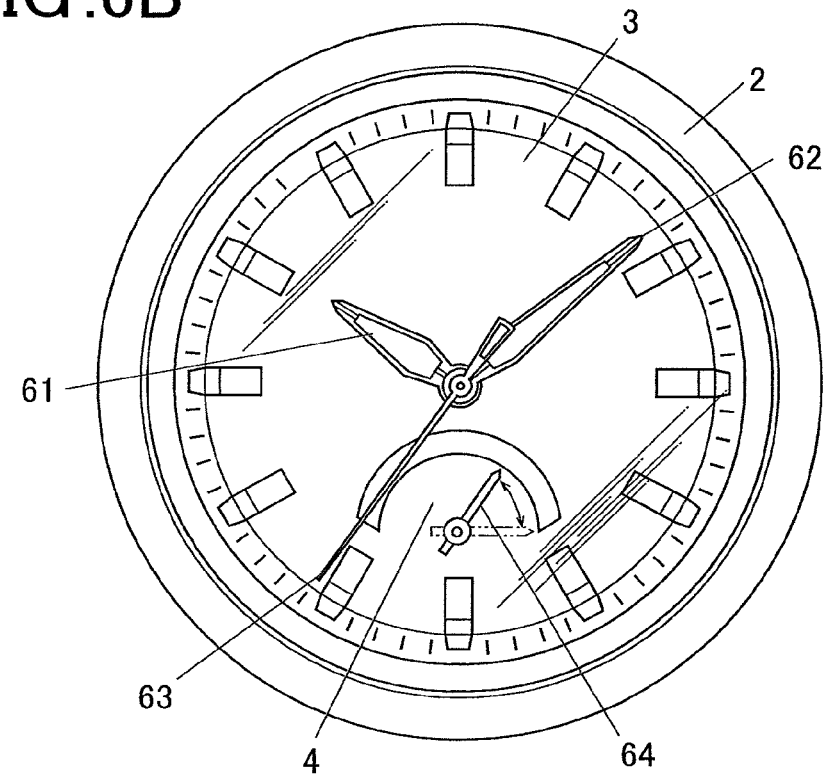
FIG. 6B is a view showing an example of notification operation performed in the measurement display control processing.

Each of FIGS. 6A and 6B is a view showing an example of notification operation executed in the measurement display control processing.

As shown in FIG. 6A, in a case of pattern 1 in which the measurement value slightly exceeds the value corresponding to the right end of display range, the swing back operation is performed by fast forwarding the function hand 64 backward for a predetermined number of steps from the right end position and thereafter returning the function hand 64 to the right end position.

As shown in FIG. 6B, in a case of pattern 2 in which the measurement value largely exceeds the value corresponding to the right end position of display range, the swing back operation is performed by fast forwarding the function hand 64 backward for the number of steps larger than the number of steps in a case of FIG. 6A from the right end and thereafter returning the function hand 64 to the right end position.

Here, in the analog electronic timepiece 1, in a case where the value range of measurement value as the display range can be changed by a predetermined number of steps by user's operation, the setting of value range to be changed and the pattern of notification operation can be associated. For example, in a case where the current measurement value can be displayed by setting the value range to be twice the current range, the CPU 41 makes the function hand 64 perform the notification operation of pattern 1. In a case where the value range needs to be more than twice the current range, for example ten times the current range, the CPU 41 makes the function hand 64 perform the notification operation of pattern 2.

The value range change operation is performed by, for example, shifting to the change mode by a predetermined push operation of push button switches 472 and 473, and selecting the value range from among a plurality of preset value ranges by rotating the crown 471. At this time, in the analog electronic timepiece 1, information according to the selected value range can be temporarily displayed by using the second hand 63, or can be indicated by the function hand 64 itself.

As described above, the analog electronic timepiece 1 in the embodiment includes a function hand 64 which is provided to be rotatable only in a partial angle range of a circle, and a CPU 41 which acquires information according to the operation of the function hand 64, and makes the function hand 64 perform a predetermined notification operation when the destination of function hand 64 determined on the basis of the information is out of the movement angle range of the function hand 64.

In such way, in a case where the user continues the operation of moving the function hand 64 out of the movement angle range and in a case where the display range based on the measurement data exceeds the current range, it is possible to let the user know that the function hand 64 is out of the movement range by making the function hand 64 perform the swing back operation not merely making the function hand 64 go out of the range. Thus, the user can rapidly respond to the situation and stop or switch the invalid operation.

Since the notification operation is performed by the function hand 64 itself, the possibility that the user overlooks the notification operation is decreased, and the user can easily understand the intention of notification operation sensuously. Furthermore, compared to a case of separately providing a mark indicating the range excess, the user recognizes the operation more easily and the range for normal display does not need to be reduced by using a part of the movement range for the mark.

In the notification operation, the CPU 41 also makes the function hand 64 perform the operation indicating the end position of movement angle range where the function hand 64 moves out of the movement angle range by a movement of function hand 64 according to the acquired information. Thus, it is possible to clearly indicate a desired response to the user.

After the notification operation is ended, the CPU 41 stops the function hand 64 at the end position of the movement angle range where the function hand 64 goes out of the movement angle range by the movement according to the information. Thus, the user can recognize the side of the movement angle range where the function hand 64 goes out of the movement angle range more easily. Furthermore, in a case of repeating the notification operation, unnecessary hand operations can be reduced easily. Even in a case where the user overlooks the notification operation, the user can recognize that the function hand 64 is moved to the end position to go out of the movement angle range as usual.

The notification operation includes a swing back operation of fast forwarding the function hand 64 for a predetermined number of steps to inside the movement angle range from the end position where the function hand 64 goes out of the movement angle range, and thereafter returning the function hand 64 to the end position by fast forwarding the function hand 64. Accordingly, it is possible to easily and clearly indicate that the request for moving the function hand 64 out of the movement angle range is acquired and the direction of the movement. Since the notification operation is started and ended at the same end position, there is no wasteful operation and the notification operation is easy to understand for the user. The notification operation is a simple operation which does not require a complicated control, and can be easily changed according to the degree of notification operation (notification amount).

The analog electronic timepiece 1 includes an operation receiving section 47 which receives user's operation, and the CPU 41 makes the function hand 64 perform the notification operation when reception information of operation according to the request for moving the function hand 64 out of the movement angle range is acquired. Accordingly, after the user's operation is received, the user can easily determine whether the hand operation has a problem or the operation itself is not received, and can switch the operation to an appropriate operation or stop the operation.

The CPU 41 determines the notification amount of the notification operation according to at least one of the acquisition frequency and the number of successive acquisitions of the reception information of operation according to the movement request for movement out of the movement angle range.

Accordingly, an unnecessary large scale notification operation is not needed in a case where the user notices that the function hand 64 is out of the movement angle range by a single operation. In a case where the user continues the invalid operation without noticing that the function hand 64 is out of the movement angle range, the large scale notification operation can be performed for the user to more easily notice that the function hand 64 is out of the movement angle range.

The analog electronic timepiece 1 includes a sensor 48 which measures predetermined physical quantity, and the CPU 41 moves the function hand 64 to the hand position determined according to the display value based on the measurement value by the sensor 48. In a case where the display value exceeds the value range according to the movement angle range of function hand 64, the CPU 41 makes the function hand 64 perform the notification operation indicating the excess. Accordingly, when the measurement operation is displayed, the user can easily notice that the measurement is executed and the display value is not within the value range which can be displayed, and the user can change the value range to be displayed or stop the measurement.

The CPU 41 determines the notification amount of the notification operation according to the excess amount of display value from the value range which can be displayed by the function hand 64. Thus, the user can easily know the degree of excess from the value range. Accordingly, the change width of changing the value range can be determined more easily. In a case where there is no need to know a specific display value, the user can know the approximate display value by only the information of notification amount.

The notification amount of the notification operation is determined by at least one of the movement width of function hand 64 in the notification operation, here, the swing back operation, fast forward speed of function hand 64 and the number of times that the swing back operation is repeated. Accordingly, the notification operation is easy to understand for a user by the simple control, and the user can know the excess amount from the upper limit or lower limit of value range which can be displayed.

The present invention is not limited to the above embodiment and various changes can be made.

For example, in the embodiment, the notification operation is performed by a swing back operation on the side where the function hand 64 moves out of the movement angle range. However, the notification operation is not limited to this. For example, the notification operation may be performed by making the function hand 64 move around the center of the movement angle range so as to point to the side where the function hand 64 goes out of the movement angle range. The notification operation may be always performed at one end position regardless of the side where the function hand 64 goes out of the movement angle range, or may be performed at an end position closer to the current position of function hand 64.

The notification amount may not be changeable, and the same notification operation may be performed uniformly.

In the embodiment, the notification operation is performed according to the hand operation based on user's operation, and according to the hand operation based on the measurement value by the sensor 48. However, the present invention is not limited to this. For example, in a case where call information from outside is acquired and the number of calls is displayed, when new call information is received in a state in which the number of calls exceeds the display range, it is possible to notify the user that a new call is received by performing the notification operation.

In the embodiment, the function hand 64 can perform the reciprocating operation in the 180 degree range on the 12 o'clock side. However, the angle range may be other angle ranges and a plurality of such hands may be provided.

The analog electronic timepiece 1 is not limited to a wristwatch, and may be other portable clocks and stand clocks.

In the embodiment, the function hand 64 is provided separately from the hands for displaying date and time. However, a part or all of the hands for displaying date and time may be limited in the movement range. As long as the function hand 64 is provided, the present invention may be applied to an electronic timepiece which displays date and time by digital display, and may be applied to an electronic timepiece provided with a hand, which is other than the time hands 61 to 63 and function hand 64, and a digital display section.

The other specific configurations, operation contents, procedures and such like shown in the embodiment can be appropriately changed within the scope of the present invention.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2015-183610 filed on Sep. 17, 2015 including description, claims, drawings, and abstract are incorporated herein by reference in its entirety.

What is claimed is:

1. An electronic timepiece, comprising: a dial; a display region having a range of less than 360 degrees which is provided on the dial; a reciprocating hand which is provided to be rotatable only within the range of the display region; an acquisition section which acquires predetermined information; and a processor which controls an operation of the reciprocating hand, wherein: a first scale value to a second scale value which is larger than the first scale value are shown on a perimeter of the display region, the processor acquires the predetermined information, acquired by the acquisition section, if the predetermined information is smaller than a value corresponding to the first scale value, the processor controls the reciprocating hand to perform a first notification operation of reciprocating in a region from a position of the display region where the first scale value is shown to a position of the display region where a scale value which is equal to an intermediate value between the first scale value and the second scale value is shown, and then back to the position of the display region where the first scale value is shown, where the reciprocating hand stops, and if the predetermined information is larger than a value corresponding to the second scale value, the processor controls the reciprocating hand to perform a second notification operation of reciprocating in a region from a position of the display region where the second scale value is shown to a position of the display region where a scale value which is equal to an intermediate value between the second scale value and the first scale value is shown and then back to the position of the display region where the second scale value is shown, where the reciprocating hand stops.

2. The electronic timepiece according to claim 1, wherein the first notification operation includes an operation of the reciprocating hand moving at a fast forwarding speed.

3. The electronic timepiece according to claim 2, wherein the acquisition section includes an operation receiving section which receives an operation by a user, and wherein, if a value acquired via the operation receiving section is smaller than the value corresponding to the first scale value the processor controls the reciprocating hand to perform the first notification operation of reciprocating in the region from the position of the display region where the first scale value is shown to the position of the display region where the scale value which is equal to the intermediate value between the first scale value and the second scale value is shown, and then back to the position of the display region where the first scale value is shown where the reciprocating hand stops.

4. The electronic timepiece according to claim 1, wherein the second notification operation includes an operation of the reciprocating hand moving at a fast forwarding speed.

5. The electronic timepiece according to claim 4, wherein the acquisition section includes an operation receiving section which receives an operation by a user, and wherein, if a value acquired via the operation receiving section is larger than the, value corresponding to the second scale value the processor controls the reciprocating hand to perform the second notification operation of reciprocating in the region from a position of the display region where the second scale value is shown to the position of the display region where the scale value which is equal to the intermediate value between the second scale value and the first scale value is shown and then back to the position of the display region where the second scale value is shown where the reciprocating hand stops.

6. The electronic timepiece according to claim 1, wherein the acquisition section includes an operation receiving section which receives an operation by a user, and wherein, if a value acquired via the operation receiving section is smaller than the value corresponding to the first scale value the processor controls the reciprocating hand to perform the first notification operation of reciprocating in the region from the position of the display region where the first scale value is shown to the position of the display region where the scale value which is equal to the intermediate value between the first scale value and the second scale value is shown, and then back to the position of the display region where the first scale value is shown where the reciprocating hand stops.

7. The electronic timepiece according to claim 6, wherein the processor determines a notification amount of the first notification operation according to at least one of an acquisition frequency and a number of successive acquisitions of reception information.

8. The electronic timepiece according to claim 1, wherein the acquisition section includes an operation receiving section which receives an operation by a user, and wherein, if a value acquired via the operation receiving section is larger than the, value corresponding to the second scale value the processor controls the reciprocating hand to perform the second notification operation of reciprocating in the region from a position of the display region where the second scale value is shown to the position of the display region where the scale value which is equal to the intermediate value between the second scale value and the first scale value is shown and then back to the position of the display region where the second scale value is shown where the reciprocating hand stops.

9. The electronic timepiece according to claim 8, wherein the processor determines a notification amount of the second notification operation according to at least one of an acquisition frequency and a number of successive acquisitions of reception information.

10. The electronic timepiece according to claim 9, wherein the notification amount is determined by at least one of a movement width of the reciprocating hand, a fast forward speed of the reciprocating hand, and a number of times that a predetermined pattern operation is repeated in the second notification operation.

11. The electronic timepiece according to claim 1, wherein the acquisition section includes a sensor which measures a predetermined physical quantity and, wherein, if a value acquired via the sensor is smaller than the, value corresponding to the first scale value the processor controls the reciprocating hand to perform the first notification operation of reciprocating in the region from the position of the display region where the first scale value is shown to the position of the display region where the scale value which is equal to the intermediate value between the first scale value and the second scale value is shown, and then back to the position of the display region where the first scale value is shown where the reciprocating hand stops.

12. The electronic timepiece according to claim 11, wherein the processor determines a notification amount of the first notification operation according to a difference between the value acquired via the sensor and the value corresponding to the first scale value.

13. The electronic timepiece according to claim 12, wherein the notification amount is determined by at least one of a movement width of the reciprocating hand, a fast forward speed of the reciprocating hand, and a number of times that a predetermined pattern operation is repeated in the first notification operation.

14. The electronic timepiece according to claim 1, wherein the acquisition section includes a sensor which measures a predetermined physical quantity and, wherein, if a value acquired via the sensor is larger than the, value corresponding to the second scale value the processor controls the reciprocating hand to perform the second notification operation of reciprocating in the region from a position of the display region where the second scale value is shown to the position of the display region where the scale value which is equal to the intermediate value between the second scale value and the first scale value is shown and then back to the position of the display region where the second scale value is shown where the reciprocating hand stops.

15. The electronic timepiece according to claim 14, wherein the processor determines a notification amount of the second notification operation according to a difference between the value acquired via the sensor and the value corresponding to the second scale value.

* * * * *